US006026663A

United States Patent [19]

Tsung-Chuan et al.

[11] Patent Number: 6,026,663

[45] Date of Patent: Feb. 22, 2000

[54] LONG SHACKLE PADLOCK

[76] Inventors: Huang Tsung-Chuan, No.282, Pao-Tai Road, Feng-Shan City, Kaohsiung Hsien; Chang Chzn-Shu, No.6, Lane502, Tzu-Hsui Road, Changhua City, both of Taiwan

[21] Appl. No.: 09/206,701

[22] Filed: Dec. 7, 1998

[51] Int. Cl.[7] ..... E05B 67/22

[52] U.S. Cl. ..... 70/39; 70/38 A; 70/386

[58] Field of Search ..... 70/25, 26, 34, 70/35, 38 R, 38 A, 38 B, 38 C, 41, 42, 43, 44, 39, 386

[56] References Cited

U.S. PATENT DOCUMENTS

| | | | |
|---|---|---|---|
| 1,728,612 | 9/1929 | Johnson | 70/39 |
| 2,116,965 | 5/1938 | Schoorel et al. | 70/38 A |
| 4,848,110 | 7/1989 | Kuo | 70/386 |
| 5,189,893 | 3/1993 | Kortenbrede | 70/38 A |
| 5,823,021 | 10/1998 | Chang | 70/38 A |

FOREIGN PATENT DOCUMENTS

| | | | |
|---|---|---|---|
| 2134967 | 8/1984 | United Kingdom | 70/38 A |

*Primary Examiner*—Darnell M. Boucher
*Attorney, Agent, or Firm*—Dougherty & Troxell

[57] ABSTRACT

A long shackle padlock includes a cylindrical housing, a lock housing fitted in the cylindrical housing, a locking means protected in the lock housing, and a shackle. The locking means can move a first bead and a second bead with a coil spring interposed between, for locking and unlocking, with the second bead fitting in a bead hole of the foot of the shackle in locking, and with the first bead pushed and moved inward by the locking means to let the second bead move inward to disengage from the bead hole of the foot of the shackle in unlocking. The locking means and the lock housing can be applied to other kinds of locks such as common padlocks, U-shaped locks, wire locks, etc.

3 Claims, 4 Drawing Sheets

LONG SHACKLE PADLOCK

BACKGROUND OF THE INVENTION

This invention relates to a long shackle padlock, particularly to one having a lock housing located in a cylindrical housing for hiding and protecting a locking means consisting of a fewer components than conventional long shackle padlocks, needing less material and increasing convenience in use. Further, the lock housing and the locking means can be applied to other kinds of locks.

Traditional long shackle padlocks generally includes a cylindrical housing, a base and a locking means placed in the cylindrical housing and a shackle, and the locking means and the base always consist of many components to result in slow production and high cost.

Further, traditional long shackle padlocks have the locking means located near one end of the cylindrical housing, liable to be hit and pried illegally to unlock the padlock.

SUMMARY OF THE INVENTION

This invention has been devised to offer a long shackle padlock provided with a lock housing and a locking means hidden and protected in the lock housing, which is hidden and protected in a cylindrical housing, and the lock housing and the locking means can be applied to other kinds of locks.

Another purpose of the invention is to offer a lock housing and a locking means consisting of more simple and fewer components to effect locking and unlocking than traditional long shackle padlocks.

The feature of the invention is a cylindrical housing for containing one or two lock housings at one end side or two end sides, and a locking means protected in the a lock hole of the lock housing, which also has a shackle hole for a foot of a shackle to fit and secured tightly not to be pulled out the of lock housing, i.e. to be locked. Further a lateral passageway is provided to communicate with the lock hole and the shackle hole for a first bead, a second bead and a coil spring between the two beads fitted therein. The first bead contacts a curved-in edge section or a curved-out edge section of an upper end of a bead pusher of the locking means for unlocking or locking. Further a first block is fitted in the lock hole and fitting around a lower post portion of the bead pusher, and a second block is also fitted in the lock hole under the first block and fitting around the lower post. The second bead contacts an outer end of the coil spring and able to engage a bead hole in a lower end of the foot of the shackle in locking. The bead pusher can be rotated by a key fitting with a lower end of the second block, activating the first bead, the coil spring and the second bead for locking and unlocking, which simplifies components used in the lock housing and the locking means.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
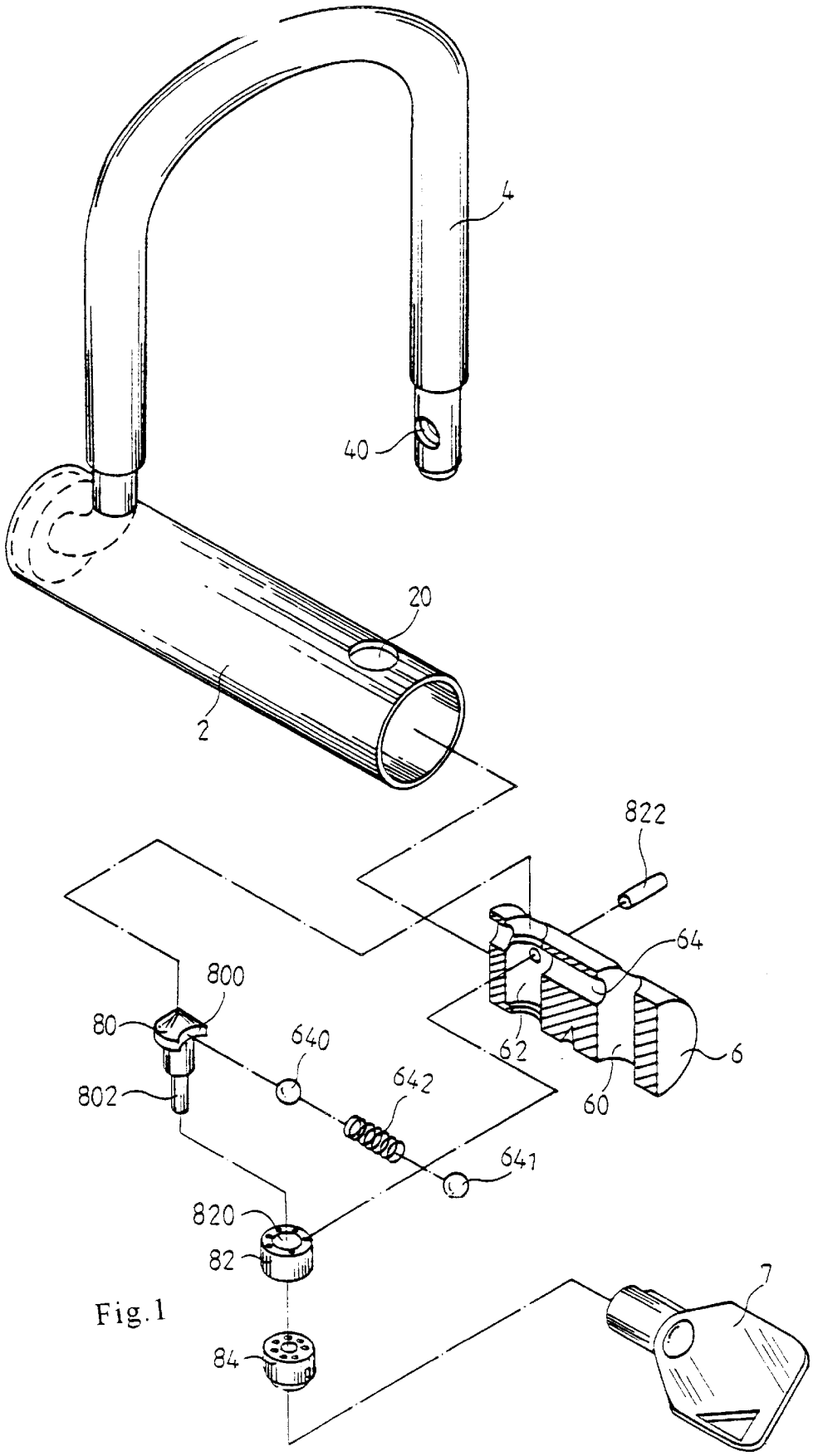
FIG. 1 is an exploded perspective view of a first embodiment of a long shackle padlock in the present invention.

A first preferred embodiment of a long shackle padlock in the present invention, as shown in FIG. 1, includes a cylindrical housing 2, a lock housing 6 fitted in the cylindrical housing 2, a shackle 4, and a locking means 8 combined together.

The cylindrical housing 2 has a shackle hole 20 respectively in two opposite end portions for two feet of the shackle 4 to fit through.

The shackle 4 is shaped as U, having one foot end bent as a hook to directly fit in and secured in one shackle hole 20 by inclined to a proper angle. The other foot end is provided with a lateral bead hole 40, and inserts in a shackle hole 60 of the lock housing 6. Then the bead hole 40 engages a bead 641 fitted movably in a passageway 64 in the lock housing 6, locking this padlock.

The lock housing 6 is located in one end portion of the cylindrical housing 2, but two lock housings 6 may be used at the same time located at two end portions of the cylindrical housing. In this description one lock housing 6 is illustrated for example. The lock housing 6 has a vertical shackle hole 60 near an outer end, and a vertical lock hole 62 located near an inner end for containing a locking means 8, and a passageway 64 communicating with the shackle hole 60 and the lock hole 62 for containing two beads 640, 641 and a coil spring 642 therein.

The Locking means 8 consists of a bead pusher 80, a first block 82, and a second block 84. The bead pusher 80 is located in the lock hole 62 of the lock housing 6, protruding upward a little out of the hole 62 and to contact the first bead 640 in the passageway 64. Further the bead pusher 80 has a curved-in edge section 800 formed in an upper end to contact and engage the first bead 640, if a key 7 is used to rotate the bead pusher 80 from the locked position wherein the first bead 640 is pushed by a curved-out edge section abutting to the curved-in edge section of the upper end of the bead pusher 80 to the unlocked position wherein the first bead 640 engaging curved-in edge section 800. Further, the bead pusher 80 has a lower post portion 802 for the first block 82 and the second block 84 to be inserted. The first block 82 is fixed with lock housing 6 with a pin 822, having a center hole 820 fitting around the post portion 802 of the bead pusher 80. The second block 84 just under the first block 82 has a lower end to engage the key 7 so as to let the key 7 rotate the second block 84 together with the bead pusher 80 for locking and unlocking.

The two—the first and the second—beads 640 and 641 are fitted movably in the passageway 64 of the lock housing 6, and the second bead 641 engages the bead hole 40 of the shackle 4, with the first bead 640 contacting and pushed by the curved-out edge section of the bead pusher 80 in locking.

The coil spring 642 is located between the first bead 640 and the second bead 641 in the passageway 64, quite easy to be assembled.

Figure 3:
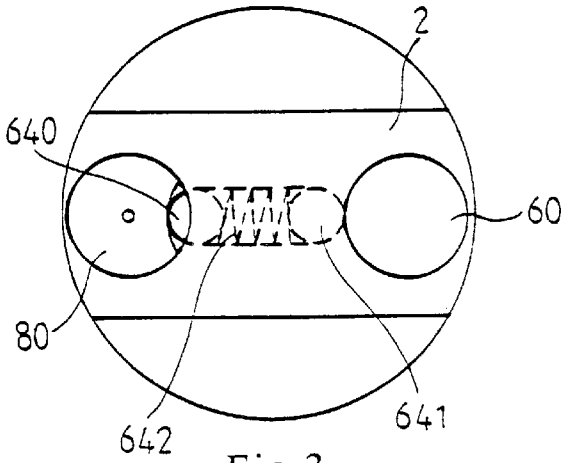
FIG. 3 is a part upper cross-sectional view of the first embodiment of a long shackle padlock in the unlocked position in the present invention.
Figure 2:
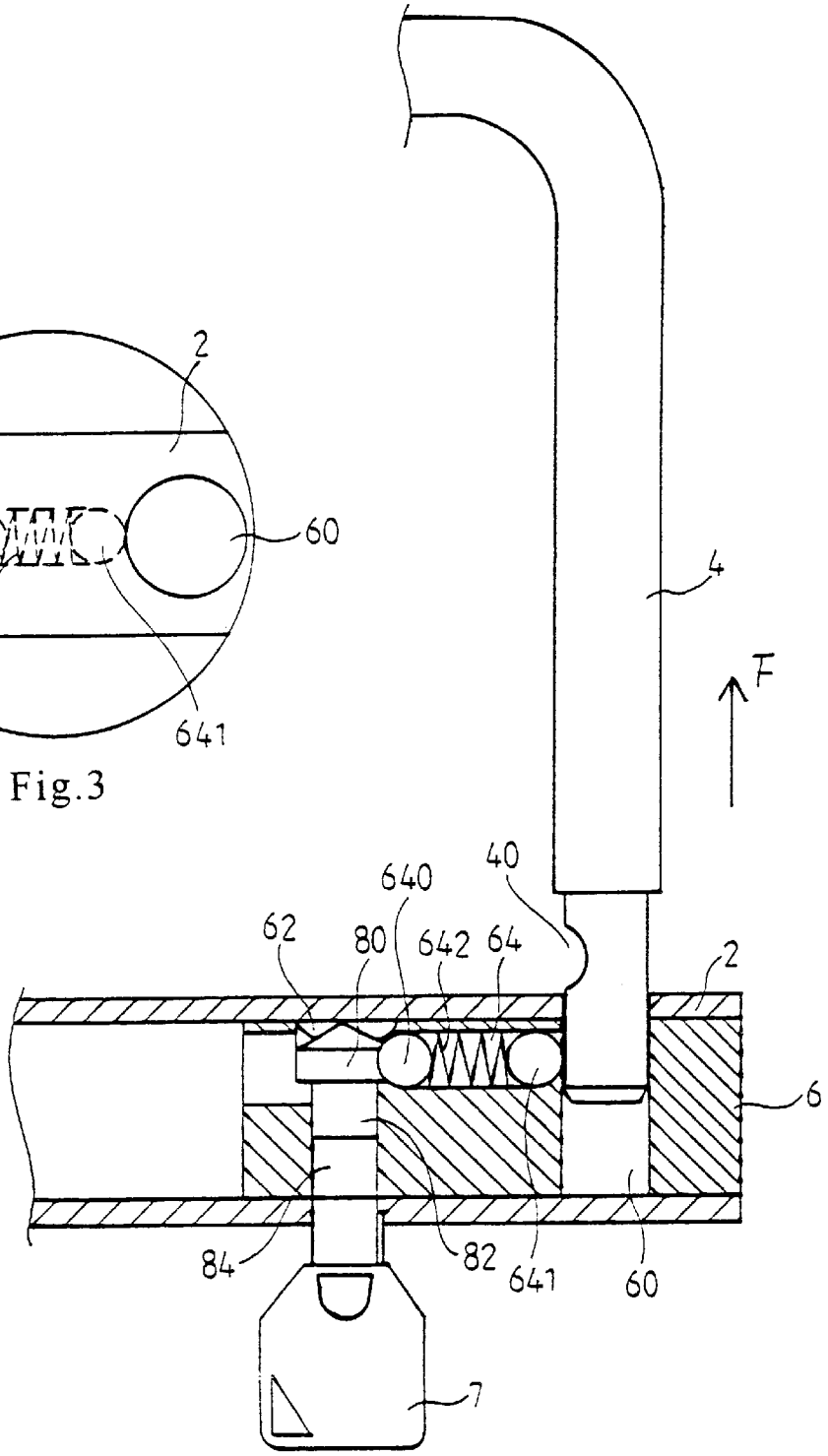
FIG. 2 is a cross-sectional view of the first embodiment of a long shackle padlock in the unlocked position in the present invention.

Next, referring to FIG. 2, the curved-in edge section 800 of the bead pusher 80 is for the first bead 640 to engage, and when the key 7 is rotated for a proper angle to rotate the second block 84 and the bead pusher 80, letting the curved-in edge 800 engage the first bead 640, with FIG. 3 also referred to. Then the locking means 8 is in the unlocked position. Consequently, the coil spring 642 has resilience to freely shrink for a certain distance, not compressed by the first bead 640 so that the foot of the shackle 4 can be pushed in the shackle hole 60 for locking or pulled out for unlocking.

As the coil spring 642 has a certain resilience to shrink in the unlocked position, the foot of the shackle 4 may be pulled out of the shackle hole 60, with the second bead 641 so far engaging the bead hole 40 of the foot of the shackle being pushed backward by the foot to compress the coil spring 642 to move inward to push the first bead 640 move to engage the curved-in edge 800, if an upward force F is added to the shackle 4. In the same principle, when the foot of the shackle 4 is completely inserted in the shackle hole 60 of the lock housing 6, the second bead 461 may be pushed outward by resilience of the coil spring 642 to move to engage the shackle hole 40 of the foot of the shackle 4 for locking by using the key 7 rotating the bead pusher 80.

Figure 5:
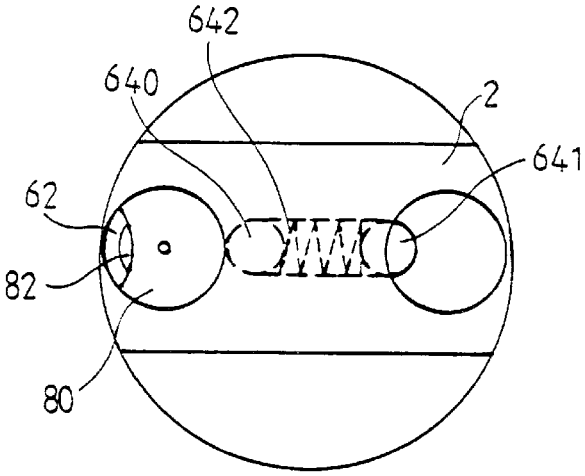
FIG. 5 is a part upper cross-sectional view of the first embodiment of a long shackle padlock in the locked position in the present invention; and, FIG. 6 is an exploded perspective view of a second preferred embodiment of a long shackle padlock in the present invention.
Figure 4:
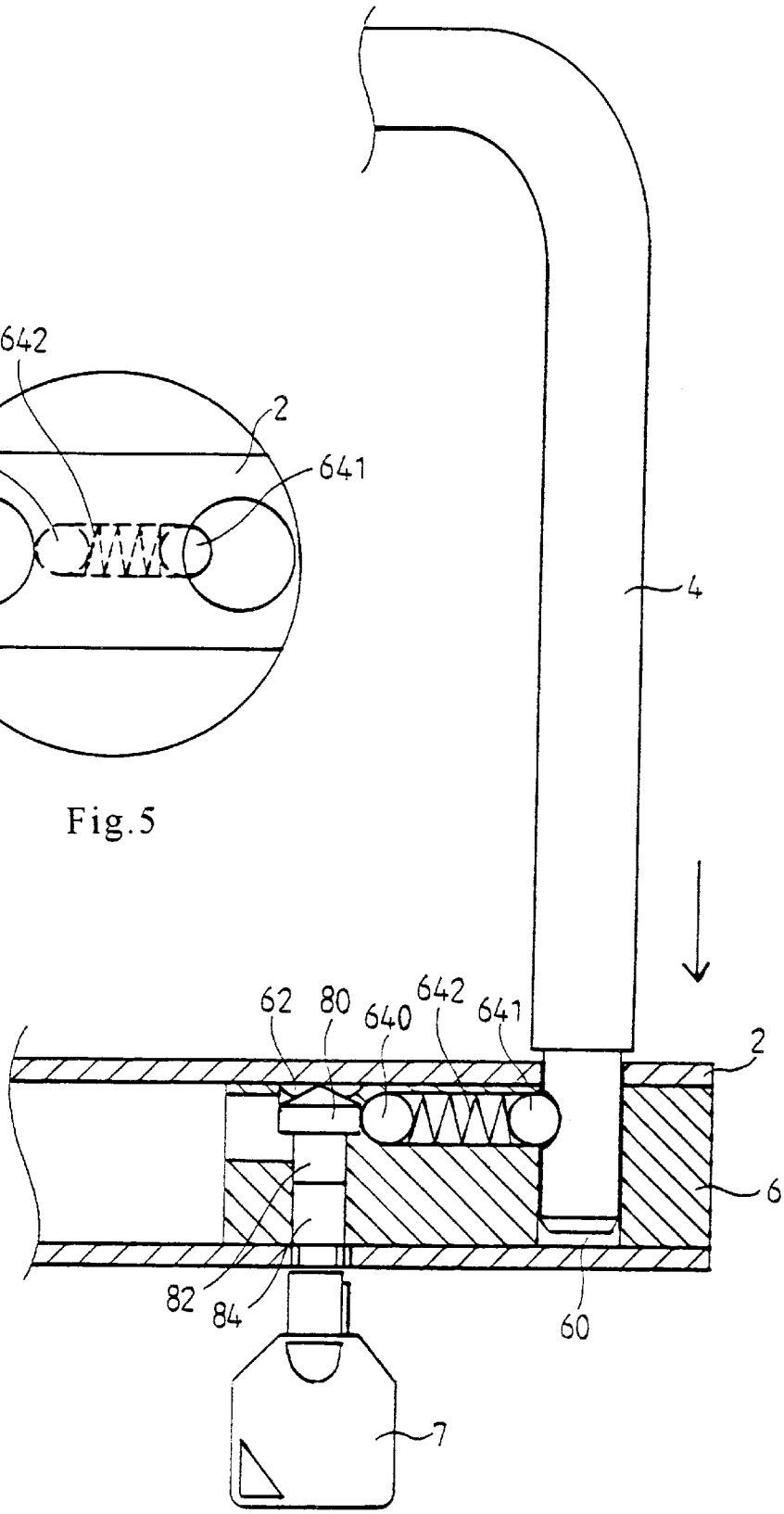
FIG. 4 is a cross-sectional view of the first embodiment of a long shackle padlock in the locked position in the present invention.

Now, referring to FIGS. 4 and 5, when the unlocked position of the locking means 8 is shifted to the locked position by the key 7 rotating the second block 84, the bead pusher 80 is also rotated, with the curved-in edge 800 also rotated for a certain angle to disengage from the first bead 640, which then gradually pushed back by the curved-out edge section of the bead pusher 80 to move in the passageway 64, with the coil spring 642 compressed and pushing the second bead 641. Consequently, the second bead 641 may move in the shackle hole 60 with no more resilience of the coil spring 642 left, and engage the shackle hole 40 of the foot of the shackle 4, forming the locked position of the padlock. It can be seen that the padlock effects locking and unlocking by using the lock housing 6, the locking means 6 and the first and the second block 82 and 84, the two beads 640, 641 and the coil spring 642 only.

Figure 6:
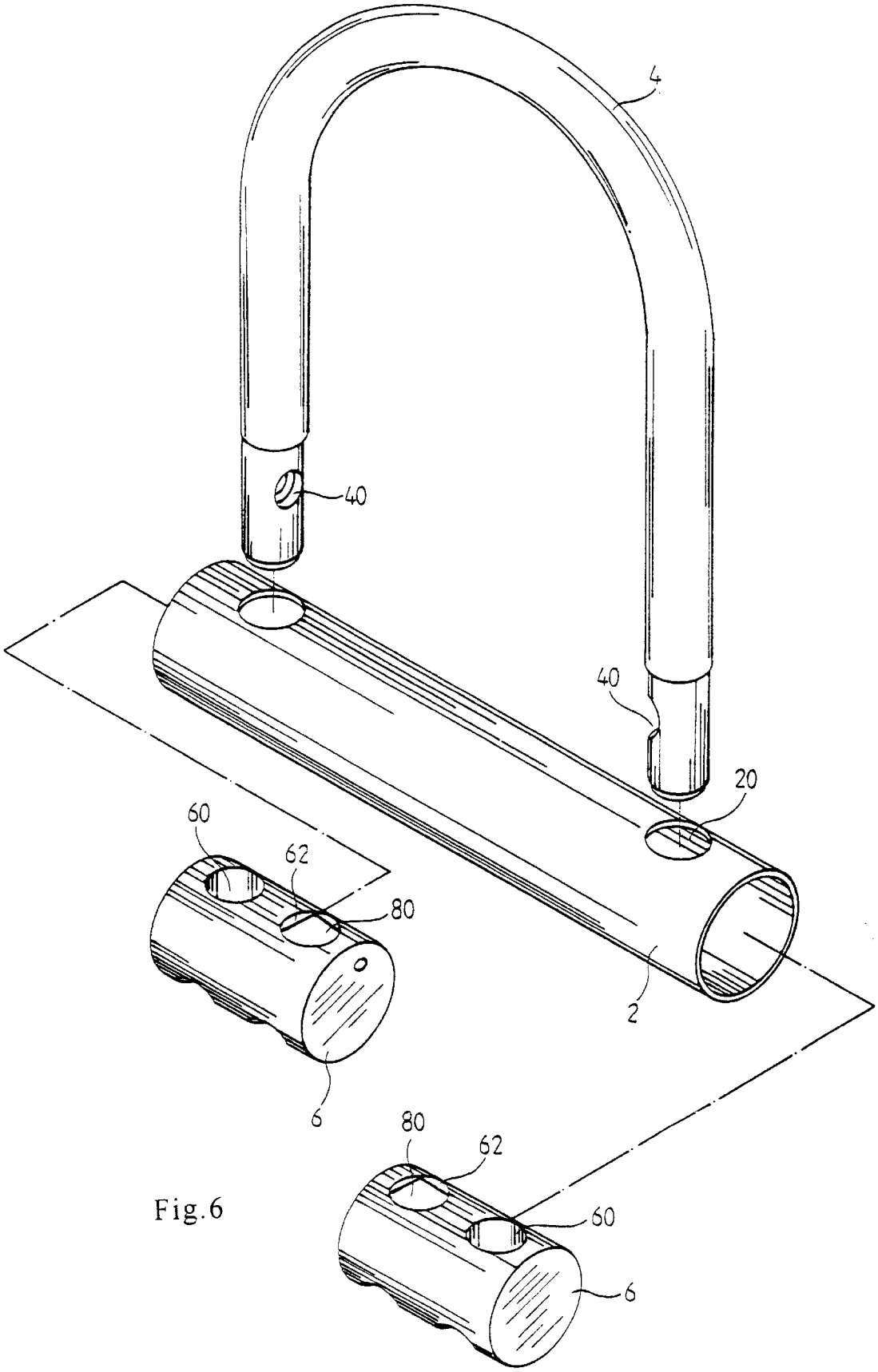

FIG. 6 shows a second preferred embodiment of a long shackle padlock in the present invention, which uses two lock housings 6 respectively located in two sides of the cylinder housing 2, instead of one lock housing used in the first preferred embodiment. And each lock housing 6 has the same structure as the first preferred embodiment and combined with the locking means 8 with the same structure as the first preferred embodiment so as to save many components used in conventional long shackle padlocks mentioned above, decreasing material and facilitating assemblage at the same time. If needed, two lock housings 6 can be fixed in the cylindrical housing 2 with no definite direction, but the lock hole 62 is preferably located near the center of the cylindrical housing 2, preventing the locking means 8 from hit or pried illegally from outside.

As a wire lock has a wire having substantial elasticity and resilience, the wire may recover its resilience and abruptly come out of a housing to hurt a user when the lock is unlocked. The chances are that the hurt may be serious. If the lock housing 6 and the locking means 8 in the present invention are applied in a wire lock, the second bead 641 is in the unlocked position, the wire may not abruptly come out of the wire hole of the housing 2, as the second bead 641 does not completely leave the bead hole 40 of the wire foot 4. So the wire can be easily pulled out of the wire hole (the shackle hole) 60 manually, with the coil spring compressed. In other words, abrupt leaving of the wire from the wire hole 60 owing to its elasticity and resilience can be avoided by means of the second bead 641 still pushing against the bead hole 40 when the lock is unlocked.

While the preferred embodiments of the invention have been described above, it will be recognized and understood that various modifications may be made therein and the appended claims are intended to cover all such modifications which may fall within the spirit and scope of the invention.

What is claimed is:

1. A long shackle padlock comprising a long shackle, a cylindrical housing, and a lock housing contained in one end portion of said cylindrical housing for containing protectively a locking means;

said lock housing shaped as a round block, having a vertical shackle hole in an outer end portion for a foot of said shackle to be pushed or pulled out of, a vertical lock hole in an inner end portion for said locking means to be placed movably therein, a lateral passageway communicating with an upper end of both said shackle hole and said lock hole, a first bead abutting to said locking means, a second bead abutting to the foot of said shackle and a coil spring located between said first bead and said second bead being contained movably in said passageway, said lock housing fitted in one end portion or respectively in two end portions of said cylindrical housing;

said locking means consisting of a bead pusher, a first block and a second block;

said bead pusher located in said lock hole of said lock housing, having its upper end protruding out of said lock hole to contact said first bead so that said first bead may fit in said bead pusher or may be pushed to move outward to effect unlocking and locking said padlock, said bead pusher further having a curved-in edge section formed in an upper end and a lower post portion extending downward;

said first block fitted in said lock hole of said lock housing, having a center hole fitting around said lower post portion of said bead pusher;

said second block also fitted in said lock hole of said lock housing, having a center hole fitting around tightly said lower post portion just under said first block and movable together with said bead pusher, and a lower end to fit with a key; and, said key rotated to rotate said first block and said bead pusher for a certain angle to permit said first bead to move near and contact said curved-in edge section for unlocking, said key rotated back for the certain angle to rotate said first block and said bead pusher back to the locked position, said first bead and said second bead located in said passageway of said lock housing, said second bead able to fit in said bead hole of the foot of said shackle and said first bead able to disengage from said curved-in edge section of said bead pusher so that said padlock may be locked.

2. The long shackle padlock as claimed in claim 1, wherein said lock housing is placed in an inner side of said cylindrical housing, for preventing said padlock from being hit or pried illegally.

3. The long shackle padlock is claimed in claim 1, wherein said lock housing is used in a common padlock, a U-shaped lock, or a wire lock.

* * * * *